US006592013B1

(12) United States Patent
Fujiwara

(10) Patent No.: US 6,592,013 B1
(45) Date of Patent: Jul. 15, 2003

(54) ROLLED PAPER DISPENSING SYSTEM

(76) Inventor: Leslie H. Fujiwara, P.O. Box 771, Kealakekua, HI (US) 96750

( * ) Notice: Subject to any disclaimer, the term of this patent is extended or adjusted under 35 U.S.C. 154(b) by 0 days.

(21) Appl. No.: 09/466,690

(22) Filed: Dec. 20, 1999

(51) Int. Cl.[7] ..... B26F 3/02

(52) U.S. Cl. ..... 225/46; 225/53; 225/77; 225/6; 225/39; 242/595

(58) Field of Search ..... 225/45, 46, 48, 225/47, 53, 77, 90, 6, 39; 242/595, 596.5, 596.8; 312/34, 8, 248

(56) References Cited

U.S. PATENT DOCUMENTS

| | | | | | |
|---|---|---|---|---|---|
| 751,214 | A | * | 2/1904 | Steeb | 225/47 |
| 1,003,995 | A | * | 9/1911 | Denoon | 225/47 |
| 1,122,672 | A | * | 12/1914 | Winter et al. | 225/53 |
| 1,502,218 | A | | 7/1924 | Van Hook | |
| 1,693,338 | A | * | 11/1928 | Honschopp | 225/47 |
| 2,003,044 | A | * | 5/1935 | Galante | 225/42 |
| 2,146,038 | A | | 2/1939 | West | 242/55.5 |
| 2,390,399 | A | * | 12/1945 | Tator et al. | 225/42 |
| 2,419,809 | A | * | 4/1947 | Avery | 156/584 |
| 2,561,584 | A | * | 7/1951 | McDonald | 242/598.3 |
| 2,683,641 | A | * | 7/1954 | Larson | 225/53 |
| 2,722,387 | A | * | 11/1955 | Tuttle | 225/45 |
| 2,726,823 | A | | 12/1955 | Jespersen | 242/55.2 |
| 3,494,518 | A | | 2/1970 | Gossi | 225/34 |
| 3,729,145 | A | * | 4/1973 | Koo et al. | 225/47 |
| 4,191,317 | A | * | 3/1980 | Harkins | 225/77 |
| 5,054,676 | A | * | 10/1991 | Ban | 225/43 |
| 5,318,210 | A | * | 6/1994 | Morand | 225/53 |
| 5,727,721 | A | * | 3/1998 | Guido et al. | 225/46 |
| 5,848,762 | A | * | 12/1998 | Reinheimer et al. | 242/595 |
| 5,868,342 | A | * | 2/1999 | Moody et al. | 242/560 |
| 5,904,316 | A | * | 5/1999 | Dunning et al. | 225/42 |
| 6,098,919 | A | * | 8/2000 | Lewis | 242/596.3 |
| 6,273,359 | B1 | * | 8/2001 | Newman et al. | 221/303 |

FOREIGN PATENT DOCUMENTS

| | | | |
|---|---|---|---|
| JP | 36310129 | 5/1988 | B65H/19/12 |

* cited by examiner

*Primary Examiner*—Boyer Ashley
*Assistant Examiner*—Thomas J Druan, Jr.
(74) *Attorney, Agent, or Firm*—Paul V. Del Giudice

(57) ABSTRACT

The perforated roll dispensing system comprises a hinged cradle within a housing enclosure with easily releasable latch lock. The semi-circular cradle trough provides a stable storage means for perforated roll products. The textured surface of the trough gives useful braking from the friction with the rotating roll for controlled metering and provides adequate resistance to tear and extract unity of the sheet material from the dispenser without unraveling. The hinge and latch feature make it easy to deploy and retract the cradle trough to the loading mode or the dispensing mode. The right angled top enclosure and back panel of the housing can be mounted on a vertical and horizontal surface.

5 Claims, 3 Drawing Sheets

ROLLED PAPER DISPENSING SYSTEM

BACKGROUND

Figure 1:
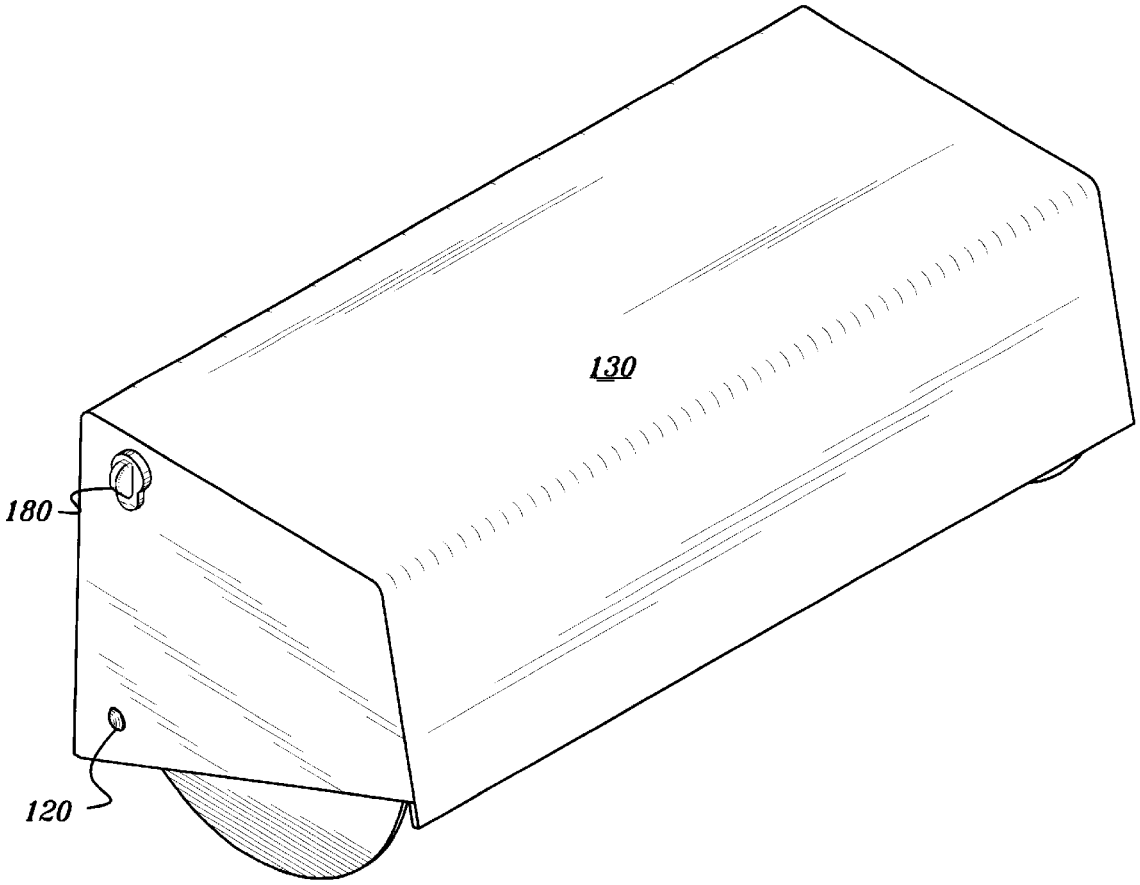

This invention relates generally to the art of dispensing sheet material. More particularly it relates to method, devices and system for dispensing rolled paper products such as paper towels, toilet paper etc.

The Problem

The problem with prior art sheet material dispensing devices and systems is that they are not suitable for hassle free, low cost dispensing of rolled paper.

a) Not hassle free b) Not integrated into a slim aesthetic portable design.

c) Not cost effective.

d) Limited functionality.

e) Operation requires too much time and skill.

f) Complex with too many moving parts.

g) Do not control precision in dispensing

They either unroll too easily (free spool types) or have difficulties from inadequate restraining and braking force or too much of it.

It is too loose, it can come free and unless you have hand ready to catch it, user would be chasing it on the floor or counter. It requires both hands to tear the sheet material from the roll. It takes a reasonably dexterous and alert person to successfully use the dispensers of the prior art. Prior art devices especially have been a problem for children, handicapped, elderly and a lot of people who are not dexterous enough.

SUMMARY

The rolled paper dispensing system of this invention comprises a cradle in a housing enclosure with easily releasable latch lock. The semi-circular cradle provides a stable storage means that can be located easily. It also gives useful braking from the friction with the rotating roll. The hinge and latch feature make it easy to deploy and retract it to the loading mode or the dispensing mode. The enclosure housing can be mounted on a vertical and horizontal surface. If mounted on a vertical surface, the top makes a handy shelf. The cutting edge guide, combined with the braking drag simplifies tearing rolled paper sheets from the dispenser. The housing enclosure prevents accidental dislodgement and contamination. Prior art dispensers have exposed rolled material. This constitutes a critical difference for some users.

PRIOR ART

A formal prior art search was conducted and furthermore the inventor is intimately familiar with the prior art. Following are typical examples of the prior art arranged in the reverse chronological order for easy reference of the reader.

5) Japanese Patent JP3-63-101249A awarded to Setsu Tanzawa of Ricoh Co Ltd in May 1998 for "Image Recording Device"

4) U.S. Pat. No. 3,494,518 presented to R G Goss on Feb. 10, 1970 for "Ribbon Dispenser"

3) U.S. Pat. No. 2,726,823 bestowed upon R W Jesperson on Dec. 13, 1955 for "Supply Roll Mounting Means for Dispensing Cabinets"

2) U.S. Pat. No. 2,146,038 blessed upon M J West on Feb. 7, 1939 for "Paper Dispensing Cabinet"

1) U.S. Pat. No. 1,502,218 earned by C F Van Hook on Jul. 22, 1924 for "Locking Device for Spools"

None of the prior art devices known to the applicant singly or even in combination disclose the EXACT embodiment of this inventor that constitutes a simple, elegant, quick, convenient, affordable solution for rolled paper dispensing.

The applicant's invention is better for the following reasons:

a) The user is not required to disassemble and assemble hardware to unload and load the rolled material.

b) There are no telescoping rods, rods with movable ends, and stud shafts on spring loaded arms to deal with.

c) The dispenser cabinet completely encloses the rolled material which prevents accidental dislodging and contamination. Finally, with the range of plastic and other materials available to make the dispenser, it can be made attractive, durable, trouble free and affordable.

Discussion of the Prior Art a) U.S. Pat. No. 3,494,518 shows a roll of ribbon coming forward and down, albeit by a mechanism very unlike the case at bar. Their second embodiment is a more complex version which is tangentially relevant here.

b) U.S. Pat. No. 2,926,823 Arms 18,19 pivot around 22 which allow for loading a roll as shown in FIG. 1.

c) U.S. Pat. No. 2,146,038: Arm 51 pivots around 53—quite clear in FIG. 1.

d) U.S. Pat. No. 1,502,218: Crank 32, said to be mounted on shaft 24, which apparently is encased in sleeve 27.

e) JP363: if you pull on 13 (FIG. 2), then the cradle 3 pops up.

Objectives

Unfortunately none of the prior art devices singly or even in combination provide for all of the objectives as established by the inventor for this system as enumerated below.

1. It is an objective of this invention to provide methods, devices and system for quickly, conveniently dispensing all types of rolled sheet material.
2. Another objective of this invention is to provide aesthetic and elegant design that integrates harmoniously with the environment.
3. Another objective of this invention is that its use is easy, simple even intuitive.
4. Another objective of this invention is that it be capable of multiple uses.
5. Another objective of this invention is that it use little or no additional energy.
6. Another objective of this invention is that it accommodate different sizes of rolled stock.
7. Another objective of this invention is that the invention use modular standard components easily interface-able to each other.
8. Another objective of this invention is that it be reliable such that it practically never fails and requires little or no maintenance.
9. Another objective of this invention is that it be made from biodegrade materials to the extent practical.
10. Another objective of this invention is that it be environmentally safe.
11. Another objective of this invention is that it be physically safe in normal environment as well as accidental situations.

12. Another objective of this invention is that it be long lasting made from durable material.
13. Another objective of this invention is that it meet all federal, state, local and other private standards guidelines, regulations and recommendations with respect to safety, environment, energy consumption.
14. Another objective of this invention is that it be suitable for gift giving.
15. Another objective of this invention is that it be suitable for promotional give aways complete with message of the sponsor such as a casino or church.
16. Another objective of this invention is that it be simple and quick to load, unload and reload.
17. Another objective of this invention is that it be easy to dispense without any surprises.
18. Another objective of this invention is to make it impossible to accidently dislodge the roll without destroying the cabinet.
19. Another objective of this invention is to protects the roll from contamination for medical, health, food processing, repair and maintenance and places where accidental contamination could be a problem.
20. Another objective of this invention is to provide an attractive device that would be acceptable for humble and upscale setting.

Other objectives of this invention reside in its simplicity, elegance of design, ease of manufacture, service and use and even aesthetics as will become apparent from the following brief description of the drawings and the detailed description of the concept embodiment.

Figure 2:
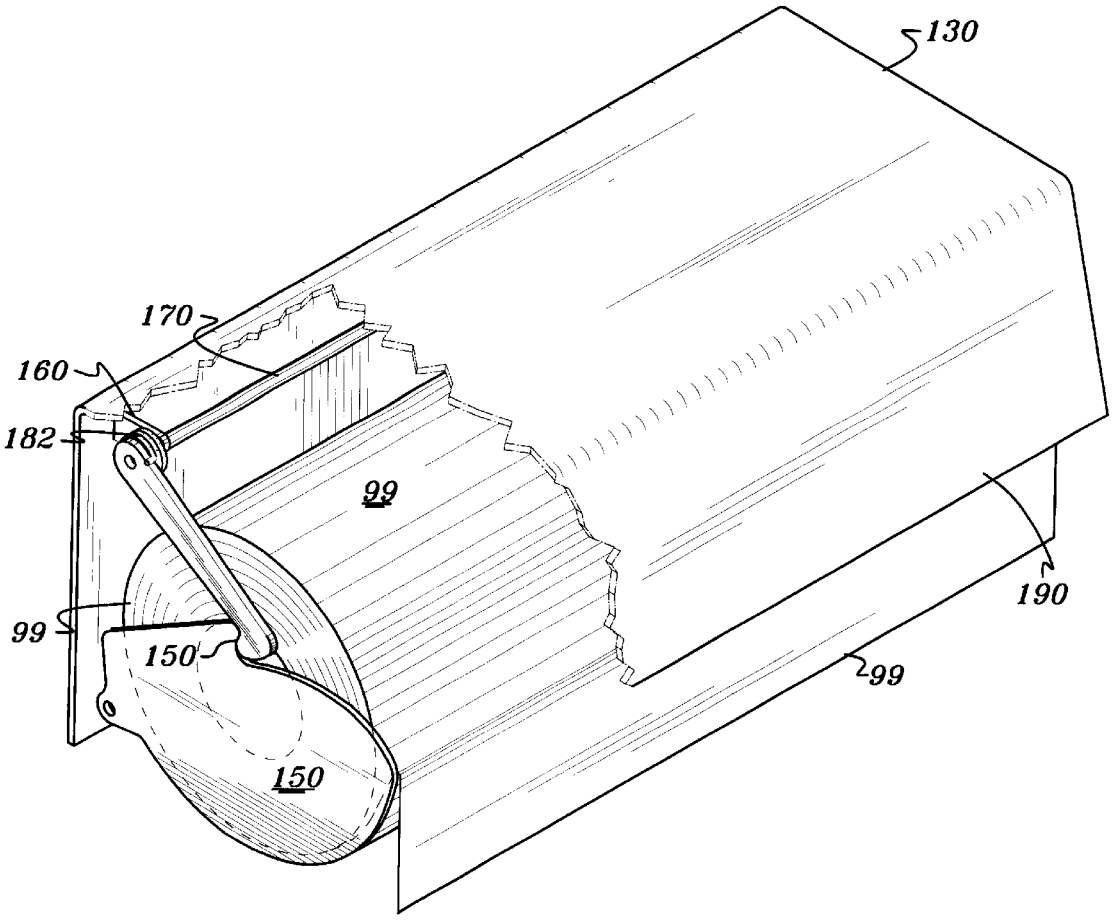
Figure 3:
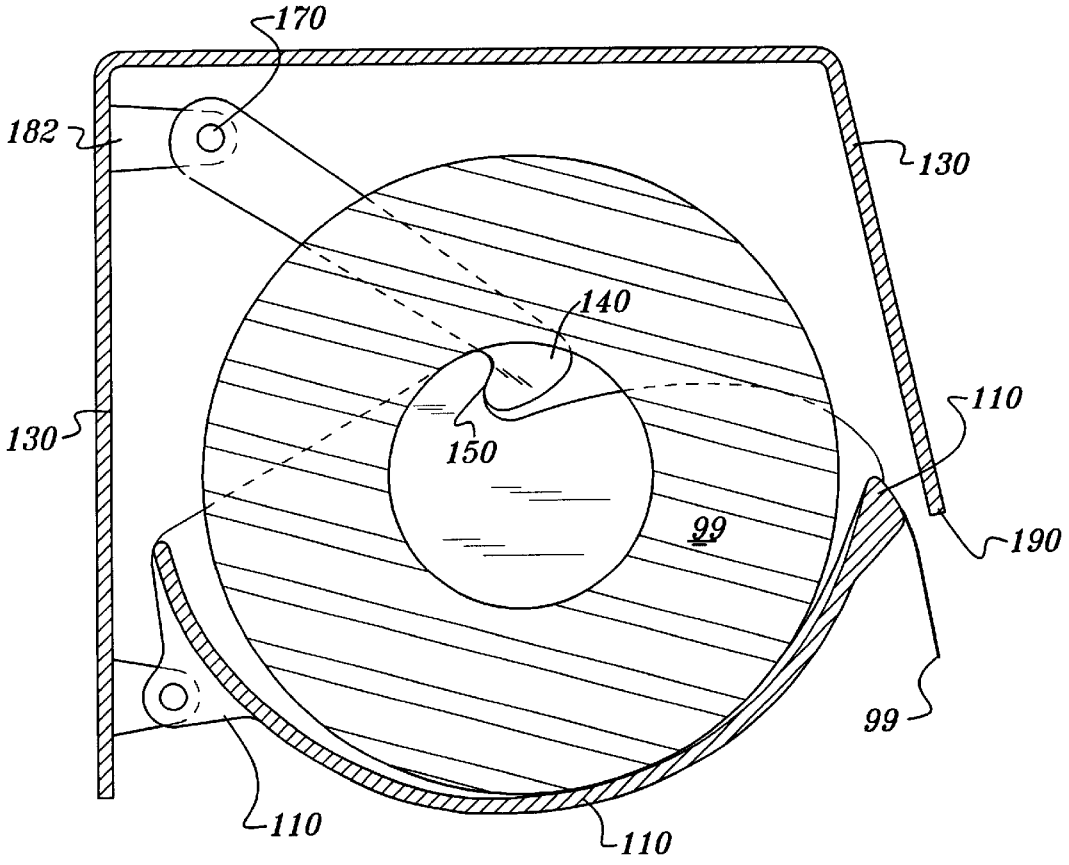

BRIEF DESCRIPTION OF THE DRAWINGS a) FIG. 1 shows a 3D isometric perspective view of the rolled paper dispensing system of this invention complete with housing 130, latch lock 150 and latch release knob 180 b) FIG. 2 is a partial exploded view showing the position of rolled paper towel 99, latch lock member 150, spring 160, interconnecting shaft 170, latch release 140.

c) FIG. 3 is a view along section 3—3 of FIG. 2 complete with inter alia paper roll 99, cradle 110, housing enclosure 130, Latch lock release knob interface 182 to latch lock release 140 and cutting edge 190.

DETAILED DESCRIPTION OF THE BEST MODE PREFERRED EMBODIMENT

The rolled paper dispensing system of this invention as shown in the drawings wherein like numerals represent like parts throughout the several views, there is generally disclosed in FIG. 1 is a 3D isometric perspective view of the rolled paper dispensing system of this invention complete with housing 130, latch lock 150 and latch release knob 180

The rolled paper dispensing system of this invention compares a cradle in a housing enclosure with easily releasable latch lock. The semi-circular cradle provides a stable storage means that can be located easily. It also gives useful braking from the friction with the rotating roll. The hinge and latch feature make it easy to deploy and retract it to the loading mode or the dispensing mode. The enclosure housing can be mounted on a vertical and horizontal surface. If mounted on a vertical surface, the top would make a handy shelf. The cutting edge guide, combined with the braking drag simplifies tearing rolled paper sheets from the dispenser. The housing enclosure prevents accidental dislodgement and contamination. Following is listing of the components used in the best mode preferred embodiment.

1) CRADLE 110: The semi-circle trough is shaped to hold and dispense the rolled paper towel. The user loads it in the open position and dispense from it when it is retracted.
2) HINGES 120: Hinges 120 on both sides permit rotational motion of the cradle.
3) HOUSING 130: Contains the cradle, locking hardware, the cutting edge guide, and the mounting surfaces for vertical or horizontal surfaces.
4) LOCK LATCH 140: This tandem installed mechanism secures and releases the cradle.
5) CATCH 150: Also tandem placed on the cradle aligned with the latch to secure the cradle.
6) SPRING 160: Attached to the shaft that rotates with the latches, provides positive pressure in the engaged position of the latch and catch.
7) SHAFT 170: Connects the tandem latches, release knobs and the spring so that turning the either release knob upwards against the spring disengages the latches.
8) LATCH RELEASE KNOBS 180: The control handle on both side of the enclosure to disengage the latches.
9) LATCH LOCK RELEASE KNOB INTERFACE 182: to latch lock release 140
10) CUTTING EDGE GUIDE 190: A straight edge over the path of the paper sheet extending from the dispenser that guides and facilitate tearing along the perforated cut line when it is aligned adjacent to cutting edge.

As can be seen in FIG. 2 which is a partial exploded view showing the position of rolled paper towel 99, latch lock member 150, spring 160, interconnecting shaft 170, latch release 140.

FIG. 3 is a view along section 3—3 of FIG. 2 complete with inter alia paper roll 99, cradle 110, housing enclosure 130, Latch lock release knob interface 182 to latch lock release 140 and cutting edge 190.

Assembly, Use and Operation

The manufacturing, assembly and use of this invention is very simple even intuitive. Nonetheless the inventor suggests the following procedure.

How To Make It?

The inventor recommends injection molding technology utilizing the wide range of plastic materials. For the upscale market where elegance and style are important considerations, incorporate stainless steel, Glass, plastic, copper, exotic woods, including sculptured designs, base releafs, textured patterns and color.

How To Use It?

The rolled paper dispenser for the paper towel and toilet tissue dispenser are designed to be mounted on a horizontal or vertical surfaces. The rolled sheet material is contained by the cradle inside cabinet, and connected to the back with hinges and held in position by a latch mechanism with a manual release control lever.

When released, the cradle swings down clear of the cabinet for reloading. A new roll with the lead end extended over the side is placed in the cradle, then raised into the cabinet to be secured by the latching mechanism.

It is then ready to dispense the rolled sheet material. There are two ways the roll can be placed in the cradle, and it depends on the quality of the rolled material as to which method to use.

The paper towel roll can be placed in the cradle with the sheet material unrolling from the bottom of the roll up along the outboard inside surface of the cradle and make a 180 degree turn down the he outboard side of the cradle. This provides maximum braking required to unroll and tear off process at the weakened perforated cut line for heavy duty roll. However if the sheet material is thinner and weaker, the roll should be loaded with the sheet material unrolling from the top of the roll not requiring the 180 degree turn, which substantially reduces braking, The sheet material will not tear when pulled to unroll it, and still have adequate braking to tear it along the perforated cut line successfully. The perforated cut line of the sheet material should be extended an inch below the horizontal straight edge to leave sufficient free end material for the next user.

There is sufficient clearance between the outboard side of the cradle and the straight edge to retrieve the free end of the material if the user is somehow left short. Dispensing procedure is relatively easy.

Following is a brief summary of the steps involved in its proper use.

1. Release a lock,
2. Let the cradle swing down, reload it with the free end properly positioned and
3. Raise it up to lock automatically.
4. Dispensing requires the use of thumb and finger only unlike the prior art which employ two handed hardware.
   a) Clasp the free end of the roll exposed below the front face of the cabinet with thumb and fore finger and smoothly pull downward gently until the next perforated cut line is extended below the horizontal bottom edge of the front panel of cabinet.
   b) Then clasp either the right or left side of the sheet material half to three quarter way up and in a sweeping motion toward the opposite side in a circular arc to cause the sheet material to bind on the horizontal lower edge to cause the tearing of the sheet at it's weakest spot, which is the perforated cut line across the sheet material.

This procedure is simple and be the second nature once the user tries it. The user naturally will devise his/her own method of extracting the sheet material.

The inventor has given a non-limiting description of this invention. Due to the simplicity and elegance of the design of this invention designing around it is very difficult if not impossible. Nonetheless many changes may be made to this design without deviating from the spirit of this invention. Examples of such contemplated variations include the following:

1. The shape and size and quantity of the various members and components may be modified.
2. The color, aesthetics and materials may be enhanced or varied.
3. A different method of fastening the transverse members may be employed.
4. Additional complimentary and complementary functions and features may be added.
5. An even more economical version or an upscale version of the device may be adapted.
6. A different method of rolled paper may be employed.
7. A fixed cradle with a straight edge attached and without a cabinet may be employed.
8. The cradle may be made adjustable to accommodate different sizes for rolled paper such as paper towels, toilet paper.
9. A cabinet with hinged cover or side door that opens to reload the rolled material may be employed
10. The cradle may be attached to a vertical track to slide down from within the cabinet to be loaded, then retracted to dispensing mode.
11. A cabinet with a fixed cradle having a movable cabinet exposing the cradle for loading may be used instead.
12. Alternatively a fixed cradle on a sliding drawer that raises the front face of the cabinet when pulled out to allow reloading with a full roll may be used.

Other changes such as aesthetics and substitution of newer materials as they become available, which substantially perform the same function in substantially the same manner with substantially the same result without deviating from the spirit of the invention may be made.

Following is a listing of the components uses in this embodiment arranged in ascending order of the reference numerals for ready reference of the reader.

99=Rolled paper

110=Hinged Cradle using various means of increasing or decreasing friction of the inside surface helpful to the dispensing process eg. Texture, coatings etc . . .

120=Hinges

130=Enclosure housing

140=Lock Latch—a means for securing and releasing the cradle.

150=CATCH—A latch to secure the cradle.

160=A Torsion spring or Extension spring

170=An interconnecting shaft or rod.

180=A pair of latch release knobs on each side

182=Latch lock release knob interface to latch lock release 140.

190=Cutting Edge Guide. The horizontal straight edge guide on the front face of the invention.

NOTE: This feature helps to make it easier to tear the sheet on the perforated cut line by localizing and concentrating the force near the perforated weakened cut line. This is especially critical when the roll is almost empty and the friction in the cradle is diminished.

DEFINITIONS AND ACRONYMS

A great care has been taken to use words with their conventional dictionary definitions. Following definitions are included here for clarification.

3D=Three Dimensional

DIY=Do It Yourself

Integrated=Combination of two entities to act like one

Interface=Junction between two dissimilar entities

Symmetrical=The shape of an object of integrated entity which can be divided into two along some axis through the object or the integrated entity such that the two halves form mirror image of each other.

While this invention has been described with reference to illustrative embodiments, this description is not intended to be construed in a limiting sense. Various modifications and combinations of the illustrative embodiments as well as other embodiments of the invention will be apparent to a person of average skill in the art upon reference to this description. It is therefor contemplated that the appended claim(s) cover any such modifications, embodiments as fall within the true scope of this invention.

What is claimed is:

1. A dispensing apparatus comprising:

a housing including a back wall, a top wall, a front wall and opposed side walls, said front wall including downwardly projecting end having a cutting edge;

a cradle pivotally connected to said back wall of said housing and positioned beneath said top wall and said front wall such that said cradle pivots into and out of the housing defined by said walls, said cradle including a concave surface, facing said top wall, and having opposed ends, said cradle for receiving and supporting a roll of material to be dispensed through a gap formed between said cradle and said end of said front wall without any use of roll engaging hubs thereby allowing the roll to rest on the cradle;

at least one catch means formed on at least one of said opposed ends of said cradle;

latch means rotatably mounted on said housing, said latch means including a spring, at least one manually engaged knob, a shaft and at least one lock latch arm, said shaft mounted to the back wall of the housing such that said shaft extends within and between said opposed side walls of housing, said at least one lock latch arm mounted on said shaft adjacent to said opposed ends of said cradle, said spring positioned between said shaft and said at least one lock latch arm for biasing said lock latch arm into to engagement with said at least one catch means formed on the cradle, said at least one manually engaged knob located outside of housing and on at least one of said opposed said walls of said housing and coextensive with said shaft within said housing such that the knob is connected to said shaft for rotating said shaft, thereby rotating said lock latch out of engagement with said at least one catch means to pivot the cradle downwardly out from the housing to permit access to said cradle for loading the cradle with the roll of material to be dispensed.

2. The dispensing apparatus of claim 1 wherein said material to be dispensed is a roll of paper freely disposed in said cradle.

3. The dispensing apparatus of claim 2 wherein said paper is perforated at spaced intervals along its length to facilitate the tearing thereof.

4. The dispensing apparatus of claim 1 wherein said material to be dispensed is a roll of paper freely disposed in said cradle.

5. The dispensing apparatus of claim 1 wherein the cradle has a textured surface frictionally engaging said roll of paper.

* * * * *